US005445685A

United States Patent [19]

Strum et al.

[11] Patent Number: 5,445,685

[45] Date of Patent: Aug. 29, 1995

[54] TRANSFORMATION PROCESS FOR PRODUCTION OF ULTRAHIGH CARBON STEELS AND NEW ALLOYS

[75] Inventors: Michael J. Strum, Pleasanton; Alfred Goldberg, Livermore; Oleg D. Sherby, Palo Alto; Richard L. Landingham, Livermore, all of Calif.

[73] Assignee: The Regents of the University of California, Oakland, Calif.

[21] Appl. No.: 34,430

[22] Filed: May 17, 1993

[51] Int. Cl.[6] ..... C22C 38/18; C21D 6/00

[52] U.S. Cl. ..... 148/324; 148/564; 148/654; 148/660

[58] Field of Search ..... 420/10, 100, 101; 148/564, 324, 654, 660

[56] References Cited

U.S. PATENT DOCUMENTS

| | | | |
|---|---|---|---|
| 2,639,985 | 5/1953 | Schauwecker | 420/100 |
| 3,951,697 | 4/1976 | Sherby et al. | 148/12 R |
| 4,448,613 | 5/1984 | Sherby et al. | 148/12 R |
| 4,533,390 | 8/1985 | Sherby | 75/126 Q |
| 4,769,214 | 9/1988 | Sherby et al. | 420/77 |
| 5,160,553 | 11/1992 | Leban et al. | 420/101 |

FOREIGN PATENT DOCUMENTS

| | | | |
|---|---|---|---|
| 756738 | 9/1956 | United Kingdom | 420/101 |

OTHER PUBLICATIONS

Frommeyer and Speis, "Structural Superplasticity of a Fine-Grained and Rapidly Solidified Ultra-High Carbon-Alloy Tool Steel X 245 VCr 10 5", *Steel Research* (Materials Technology) 62(6): 261-265 (1991).

Grossmann and Bain, *Principles of Heat Treatment*, pp. 110-113 (Krauss, ed., 1964).

Kum et al., "Superplastic Ultrahigh Carbon Steels", Conference on Superplastic Forming (Los Angeles), pp. 32-42 (Mar. 24, 1984).

Nakano et al., "Effects of Chromium, Molybdenum and Vanadium on Spheroidization of Carbides in 0.8% Carbon Steel", *Transactions of the Iron & Steel Institute of Japan (ISIJ)*, 17: 110-115 (1977).

Sherby, "Damascus Steel Rediscovered?", *Transactions of the Iron & Steel Institute of Japan (ISIJ)*, 19: 381-390 (1979).

Sherby et al., "Ultrahigh Carbon Steels", *Journal of Metals:* 50-55 (Jun. 1985).

Strum, "Superplastic Steels: Joint LLNL and Industry Research", *ETR* 18-28 (Nov. 1989).

Wadsworth and Sherby, "Influence of Nickel and Vanadium on Superplasticity in Ultrahigh-Carbon Steels", *Journal of Mechanical Working Technology*, 2: 53-66 (1978).

*Primary Examiner*—Deborah Yee

*Attorney, Agent, or Firm*—Henry P. Sartorio

[57] ABSTRACT

Ultrahigh carbon steels with superplastic properties are produced by heating a steel containing ferrite and carbide phases to a soaking temperature approximately 50° C. above the $A_1$ transformation temperature, soaking the steel above the $A_1$ temperature for a sufficient time that the major portion of the carbides dissolve into the austenite matrix, and then cooling the steel in a controlled manner within predetermined limits of cooling rate or transformation temperature, to obtain a steel having substantially spheroidal carbides. New alloy compositions contain aluminum and solute additions which promote the formation of a fine grain size and improve the resistance of the carbides to coarsening at the forming temperature.

23 Claims, 5 Drawing Sheets

750 °C
(1382 °F)

4 μm

700 °C
(1292 °F)

4 μm

3°C/MIN

20°C/MIN

EDGE

CENTER

EDGE

+50%/735°C
(1355°F)

+50%/700°C
(1292°F)

2 μm

TRANSFORMATION PROCESS FOR PRODUCTION OF ULTRAHIGH CARBON STEELS AND NEW ALLOYS

The United States Government has rights in this invention pursuant to Contract No. W-7405-ENG-48 between the United States Department of Energy and the University of California for the operation of Lawrence Livermore National Laboratory.

BACKGROUND OF THE INVENTION

This invention relates to an improved process for the production of ultrahigh carbon steels which have ultrafine grains and highly spheroidized carbides.

Production of such steels in general is described in a number of sources, including U.S. Pat. Nos. 3,951,697; 4,448,613; 4,533,390 and 4,769,214 to Sherby et al. Ultrahigh carbon steel (UHCS) alloys generally contain hypereutectoid carbon contents, and may contain small amounts of other elements including but not limited to chromium, silicon and/or aluminum. Typically, UHCS alloys, that comprise only small amounts of elements other than carbon and iron, have carbon contents very roughly intermediate between conventional hypoeutectoid carbon steels (about 0.1–0.8 wt. %) and cast irons (generally greater than 2.1 wt. %).

It has been found particularly desirable to produce UHCS alloys with superplastic properties; that is, having the ability to be deformed at elevated temperatures to exceptionally large tensile strains without fracturing. Such alloys may be used to manufacture objects of complicated shape by relatively simple forming procedures, rather than by assembly of many small parts involving machining and joining. The characteristic feature of superplastic materials is the microstructure. An ultrafine grain size (generally from about 1 to about 5 micrometers) is essential for superplasticity.

To obtain the ultrafine grains required for superplasticity of the UHCS alloys, there must be two phases present, one or each of which prevents the other from coarsening. In the UHCS alloys, the two phases are iron (ferrite) and iron carbide (cementite) or another carbon-rich phase. The processing of UHCS alloys to obtain steel with superplastic properties generally involves two stages. In the first stage, a relatively homogeneous material containing pearlite, a lamellar mixture of ferrite and cementite plates, is produced. In the second stage, the pearlite microstructure is converted or transformed to a superplastic microstructure wherein the carbides are predominantly spheroidized, and the ferrite is ultrafine-grained.

One technique used for producing the spheroidal type of microstructure required for superplasticity is termed "Divorced Eutectoid Transformation"("-DET") and is described in U.S. Pat. No. 4,448,61.3. In that process, the steel is heated to a soaking temperature approximately 50° C. above the $A_1$ transformation temperature (i.e., slightly above the pearlite stability range), and held at that temperature for a time sufficient to dissolve the major portion of the carbides into the austenite matrix. In that step, according to the patent's disclosure, the carbon is distributed nonuniformly within the austenite. Then, the steel is cooled at a rate equivalent to air cooling. According to the '613 patent, for superplasticity it is desirable that the carbide particles in the alloy, after processing, remain finely distributed. The nondesirability of a continuous network of carbide particles is noted.

Deformation of the alloy may be carried out during the DET process. That variation is known as the DETWAD (Divorced Eutectoid Transformation With Associated Deformation) process.

Nakano et al., Transactions ISIJ, 17: 110–115 (1977) showed that the divorced eutectoid transformation (DET) could occur in steels having significantly less carbon than UHCS, upon slow cooling (20° C./hour) from above the $A_1$ transformation temperature.

The DET process functions well to produce superplastic steels when used with alloys having compositions as described in U.S. Pat. No. 4,448,613. However, more recently, other elements such as aluminum have been added to UHCS alloys, to increase their superplastic forming temperature while maintaining good hot ductility and cold workability, for instance as described in U.S. Pat. No. 4,769,214. In addition to aluminum, such alloys contain a stabilizing element which acts to stabilize iron carbides against graphitization. Such stabilizing elements can include up to about 2 weight % chromium or 0.4 weight % molybdenum. U.S. Pat. No. 4,769,214 states that the DET and DETWAD processes may be used satisfactorily to treat such alloys However in practice, a dramatically reduced fraction of spheroidal carbides was formed with such alloys. On investigation it was determined that the cooling rate equivalent to air cooling is a primary cause of the decrease in the fraction of spheroidal carbides and consequent decrease in desirable superplasticity qualities.

SUMMARY OF THE INVENTION

This invention comprises a method for processing an ultrahigh carbon steel employing controlled cooling methods in a divorced eutectoid transformation (DET) process. The steel containing pearlite and carbide phases is heated to a soaking temperature approximately 50° C. above the $A_1$ transformation temperature and then soaked at a temperature above the $A_1$ temperature for a sufficient time that the ma or portion of the carbides dissolve into the austenite matrix. Thereafter the steel is cooled in a controlled manner within predetermined limits of cooling rate or transformation temperature whereby a steel having substantially spheroidal carbides is obtained.

Further, this invention comprises ultrahigh carbon steel (UHCS) alloys (hypereutectoid carbon steel alloys) produced by the processes of this invention. Such alloys have a superplastic microstructure—spheroidal carbides and ultrafine grain size. This invention also comprises certain new UHCS alloys. Preferred UHCS alloys of this invention include carbon in a percentage range by weight of from above 0.5 to about 2.1, preferably from about 0.8 to about 1.8, and more preferably from about 1.2 to about 1.6.

BRIEF DESCRIPTION OF THE FIGURES

The Figures are scanning electron micrographs of alloys For comparison.

FIG. 1 shows the microstructure of a UHCS alloy containing 1.6% Al, 1.5% Cr, 0.5% Mn and 1.3% C formed using the DET process described in the '613 patent. The microstructure is predominantly pearlitic with spheroidal proeutectoid carbides.

Figure 1:
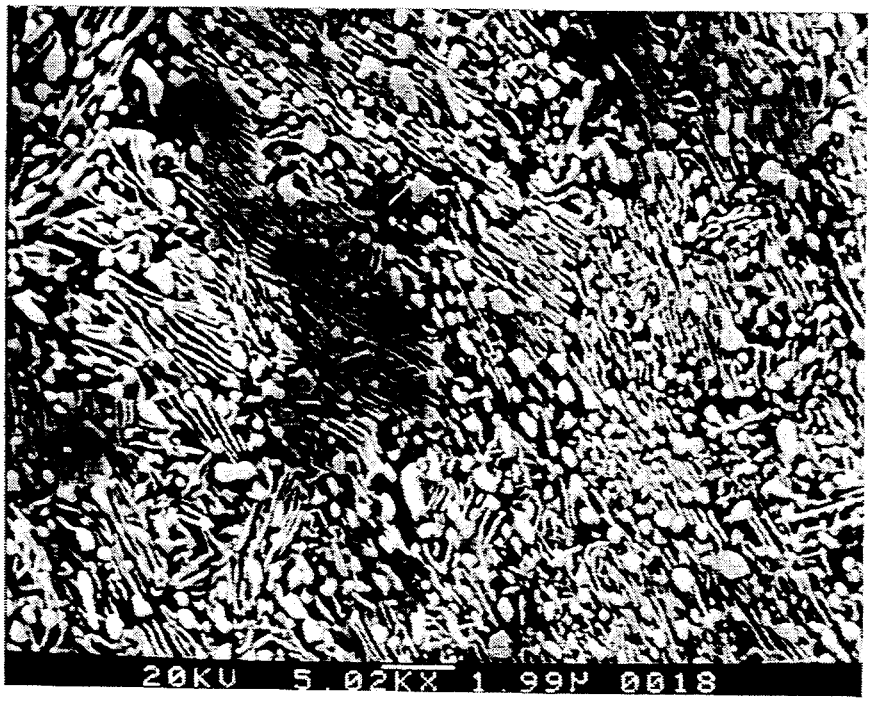
FIGS. 1 and 4A–4B depict alloys processed by methods outside the scope of the invention using methods described by Sherby et al. in U.S. Pat. No. 4,448,613.
Figure 2A:
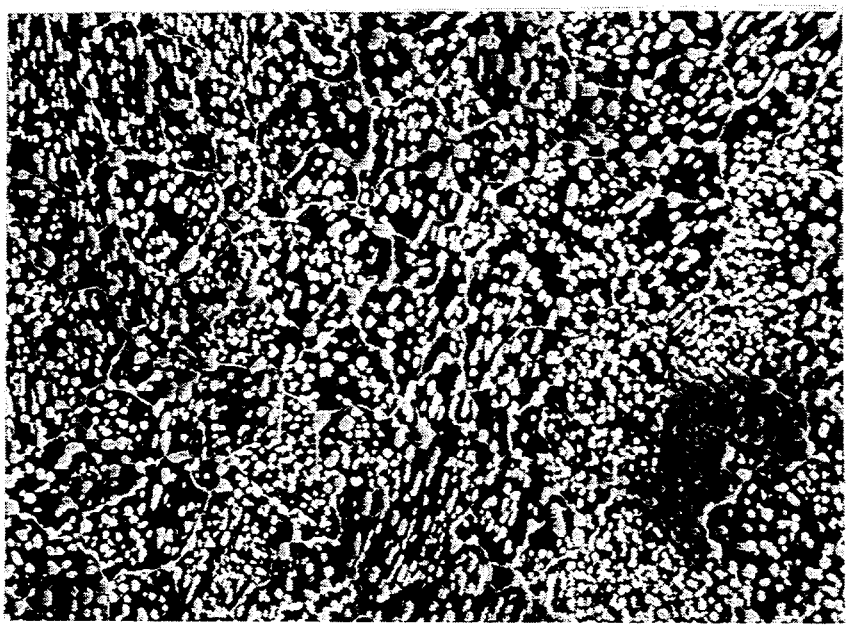
FIGS. 2A–2A, 3A–3B, 5 and 6 depict alloys produced in accordance with the processes of this invention.
Figure 2B:
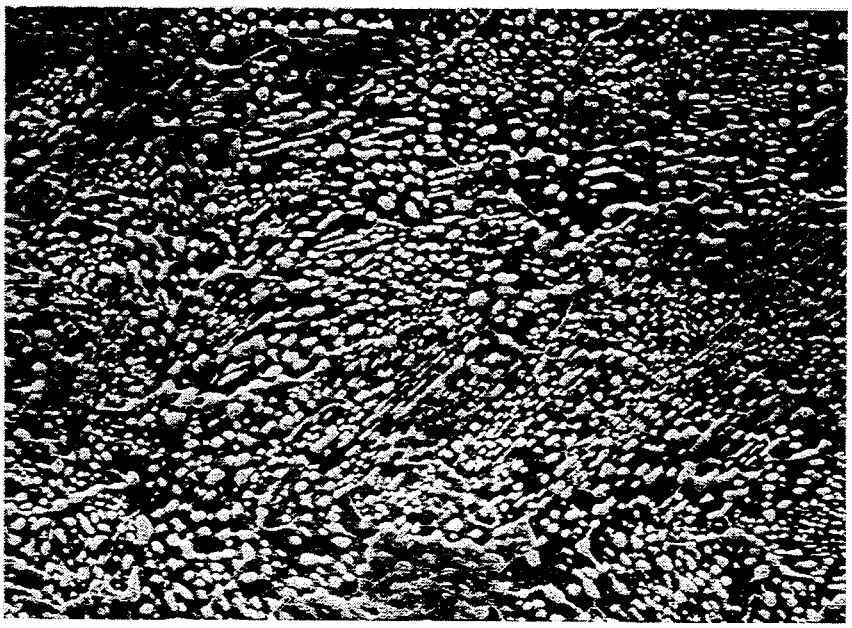

FIG. 2A–B shows the substantially spheroidal carbide microstructure in an UHCS alloy containing the same percentage weights of components as in FIG. 1, that is, 0.5% Mn, 1.6% Al, 1.5% Cr and 1.3% which was prepared C, according to Method 1 "Interrupted Cooling" of this invention The alloy was prepared in procedures wherein the second soaking temperature was 750° C. and 700° C. respectively as shown in FIGS. 2A and 2B.

Figure 3A:
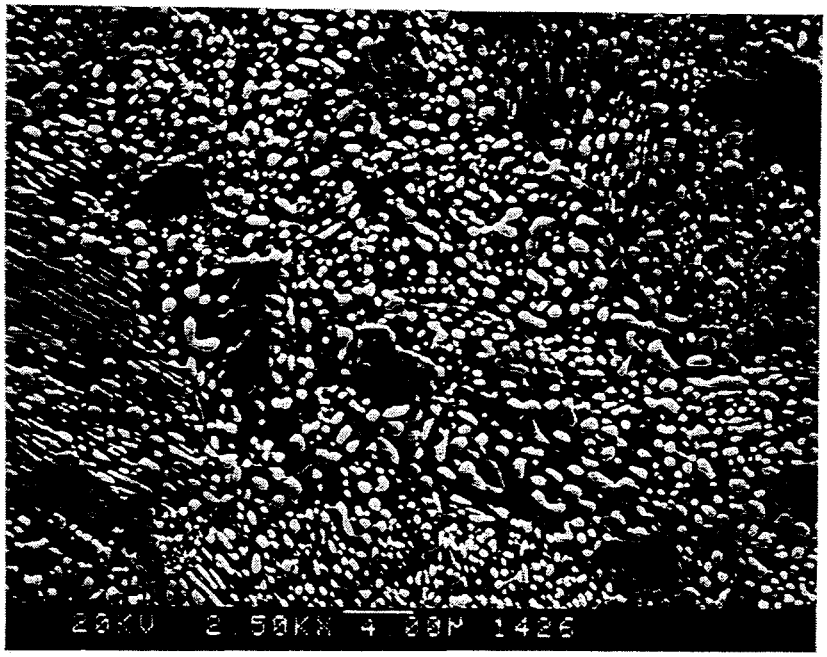
Figure 3B:
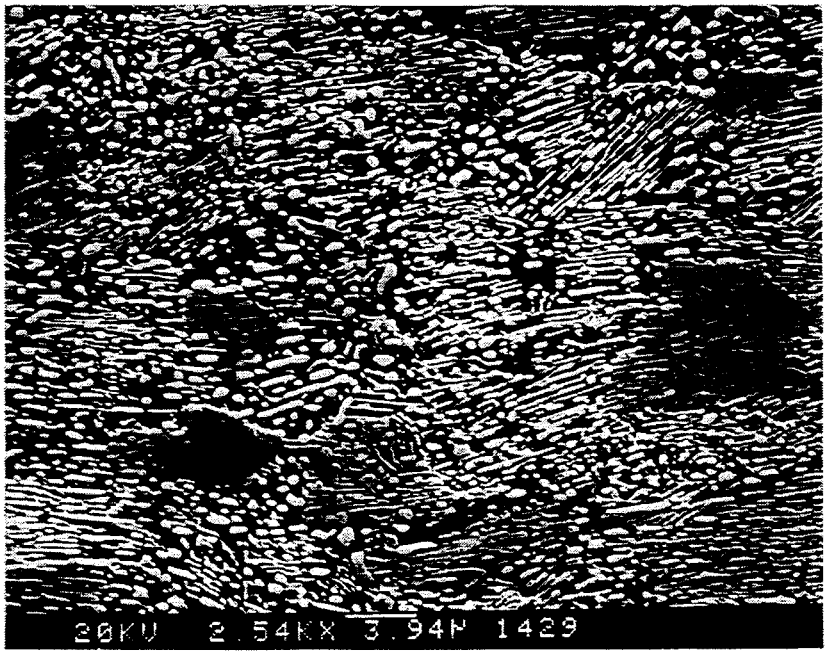
Figure 4A:
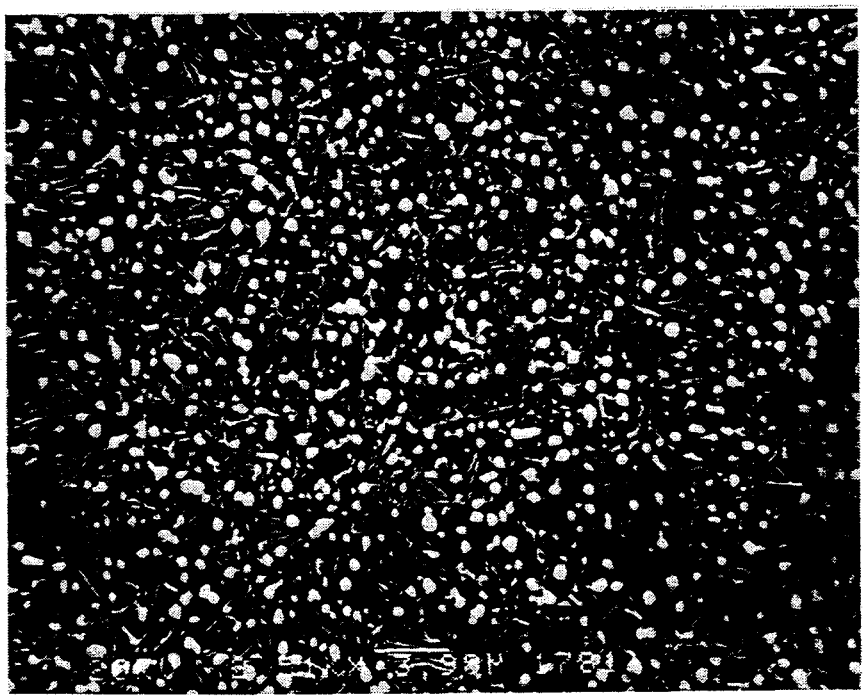
Figure 4B:
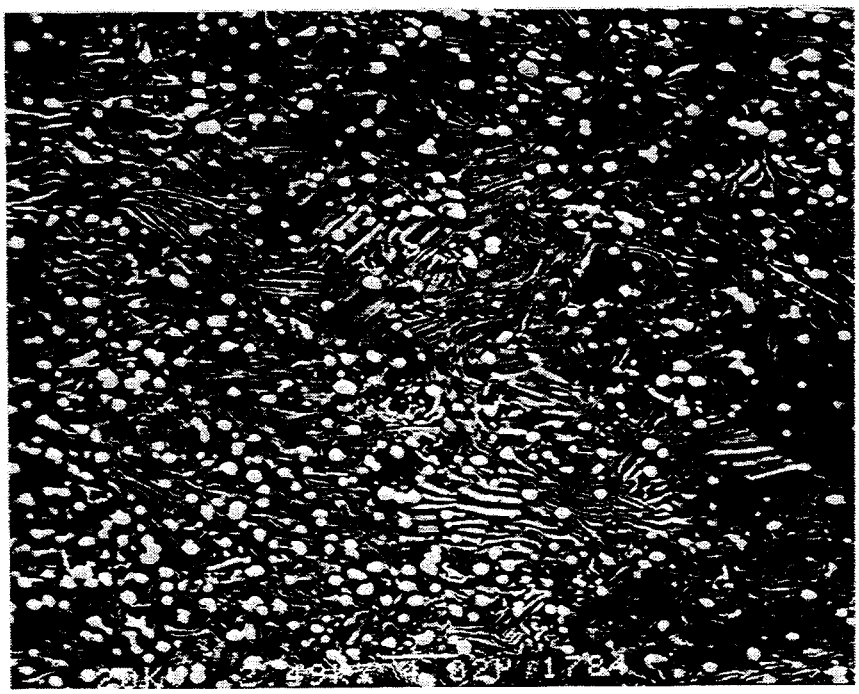
Figure 5:
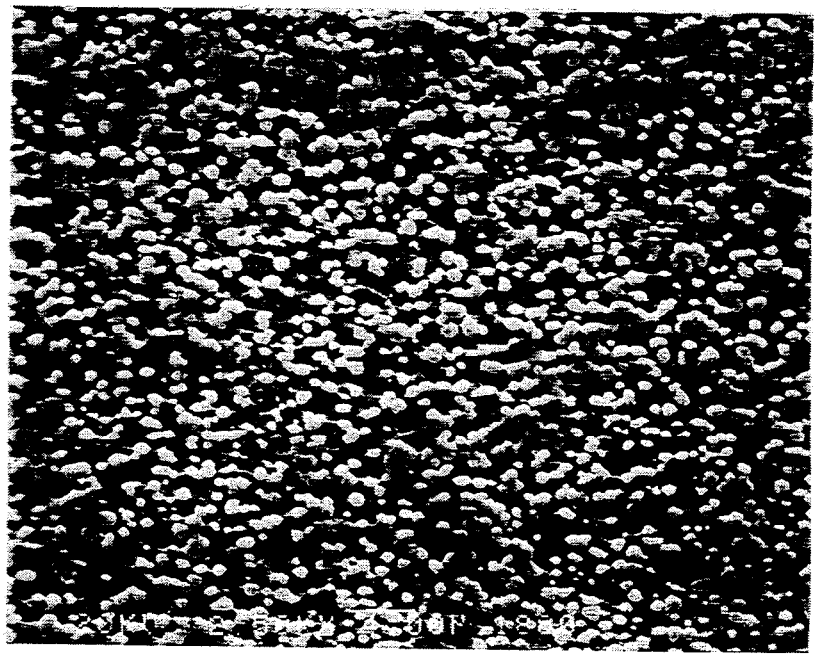

FIG. 3A–B shows the microstructures for a UHCS alloy containing 1.3% C, 1.6% Al, 0.5% Si, 1.5% Cr, and 0.5% Mn prepared at different cooling rates The microstructure, wherein the carbides are substantially spheroidal, shown in FIG. 3A was cooled at a rate of 3° C. per minute The microstructure of FIG. 3B contains significant amounts of elongated or lamellar carbide structures; it was cooled at 20° C. per minute FIGS. 4A–B and 5 show the microstructures of an UHCS alloy containing 1.3% C, 1.5% Al, 1.5% Cr, and 0.5% Mn wherein the contrasting microstructures evidence the importance of controlled cooling rates. FIGS. 4A (edge of plate) and 4B (center of plate) show an undesirable microstructure of lamellar eutectoid carbides The alloy in FIGS. 4A–B was prepared according to the '613 patent by continuous deformation both above and below the $A_1$temperature and cooled at a rate equivalent to air cooling In contrast, the microstructure shown in FIG. 5 is desirable in that it comprises substantially spheroidal carbides. The alloy in FIG. 5 was prepared by Method 3 "Controlled Cooling and Associated Deformation" of this invention with the same amount of deformation as, but at a cooling rate decreased from that used to produce the alloy shown in FIGS. 4A–B.

Figure 6:
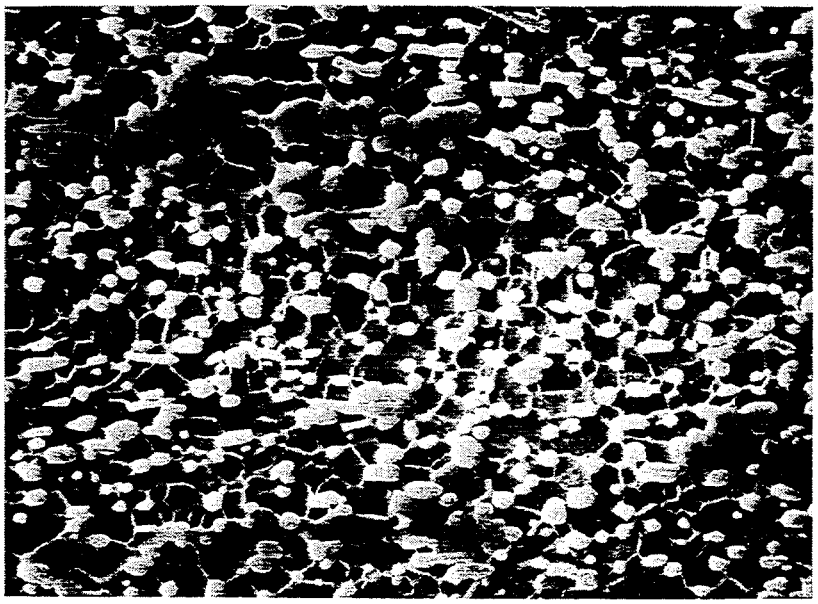

FIG. 6 shows the microstructure of an UHCS alloy containing 1.3% C, 1.6% Al, 1.5% Cr and 0.5% Mn prepared according to Method 4 "Controlled Cooling with Subsequent Deformation" of this invention. The microstructure shows an ultrafine ferrite grain size (about 1 micron in diameter).

DETAILED DESCRIPTION OF THE INVENTION

In accordance with the DET process as described (for instance) in U.S. Pat. No. 4,448,613, the steel, after having been processed to a certain extent, contains pearlite and carbide. The lamellar pearlite structure is converted or transformed to a more spheroidal one by heating the steel to a soaking temperature which is about 50° C. above the $A_1$transformation temperature of the steel, and holding the steel (or soaking it) at a temperature above the $A_1$ transformation temperature for sufficient time to dissolve the major portion of the carbides into the austenite matrix. Thereafter the steel is cooled at a rate equivalent to air cooling according to the '613 patent. The reverse transformation of the austenite to ferrite plus carbides takes place during the cooling.

According to the invention, the desired structure consisting of substantially spheroidal carbides is obtained only if the transformation occurs above a minimum transformation temperature during the cooling process. The minimum temperature is relatively close to the $A_1$ transformation temperature of the alloy in question.

The process of the present invention involves replacing the cooling rate described for the DET and DETWAD process (i.e., a rate equivalent to air cooling) with a more controlled cooling conducted within predetermined limits of either cooling rate or transformation temperature. The maximum cooling rate or minimum transformation temperature which produces substantially spheroidal carbides can be easily determined for each steel alloy through trial heat treatments. The minimum transformation temperature is typically no more than 100° C. below the equilibrium transformation temperature ($A_1$) of the steel. The maximum cooling rate varies with steel alloy composition but is at a rate slower than air cooling, for example in a range of from about 0.01 degrees Centigrade (° C.) to about 60° C. per minute and more typically 0.6° C. to about 20° C. per minute. Examples are given below.

The process of the present invention produces a steel which has an ultrafine distribution of spheroidal carbides (generally less than 1 micron in diameter). With associated or subsequent deformation in addition to the controlled cooling treatment, the resulting steel possesses a fine ferrite grain size and the superplastic properties desired for UHCS alloys.

The process of this invention can be utilized with previously known UHCS alloys. A particular advantage of this invention is that it can be applied to steels containing alloy additions such as Al, Si, Mo, Ni, V, Cr, C and others which decrease the rate of the eutectoid transformation to such an extent that the known processes such as DET and DETWAD do not produce substantially spheroidal carbides. In such steels substantially spheroidal carbides are produced only by using the controlled cooling of this invention.

COMPARISON EXAMPLE

An example of the structure formed using the DET process described in U.S. Pat. No. 4,448,613 with a UHCS steel containing 1.6% Al, 1.5% Cr, 0.5% Mn, and 1.3% C (i e. of the type described in U.S. Pat. No. 4,769,214) is shown in FIG. 1. The sample was originally pearlitic with no massive cementite plates or carbide networks, as prescribed by the '613 patent. The sample was then heated above the $A_1$temperature at 812° C. for a total of one hour, which produced a microstructure consisting of spheroidized proeutectoid particles and dissolved pearlite with non-uniformly distributed carbon in accordance with the '613 patent. The sample was then air cooled to room temperature as directed by the '613 patent. That treatment did not produce the spheroidized eutectoid carbides described in the '613 patent. Instead, the microstructure was predominantly pearlitic with spheroidal proeutectoid carbides. Variations in the time of the heat treatment above $A_1$ between 15 minutes and 2 hours did not prevent a predominantly pearlitic, non-spheroidal microstructure from forming. The elongated carbides are typical of the products obtained when UHCS alloys containing aluminum additions are prepared according to the '613 patent's process.

The controlled cooling of this invention may be carried out in the following ways.

Method 1: Interrupted Cooling

After soaking above the $A_1$ transformation temperature, the steel is cooled at any convenient rate to a second soaking temperature below the $A_1$ transformation temperature and above a predetermined lower temperature and held at that second soaking temperature for a period of time sufficient for the substantial completion of the transformation. Further cooling to room temperature can be completed at any convenient rate. The time required for completion of the transformation of a given composition is dependent on the second soaking temperature but can be determined by simple rapid quenching experiments by those skilled in the art.

FIG. 2A–B shows the substantially spheroidal carbides produced in an alloy treated by this variation of the invention. In amounts by weight the alloy contained 1.3% C, 1.6% Al, 1.5% Cr and 0.5% Mn. The alloy was soaked at 40° C. above the $A_1$ transformation temperature, then cooled to a second soaking temperature of 750° C. and held at that temperature for 1 hour. The resulting microstructure is shown in FIG. 2A. The minimum second soaking temperature for this alloy was determined to be near 700° C. The resulting microstructure is shown in FIG. 2B.

Method 2: Cooling Within Predetermined Upper Rate After soaking, the steel is cooled at a cooling rate below a predetermined upper rate limit to a temperature at which the transformation is substantially complete. Those limits are predetermined for each different steel composition to be treated by trial heat treatments. Upon completion of the transformation, the cooling rate can be altered to any convenient value.

The maximum cooling rate for a UHCS alloy containing 1.6% Al, 0.5% Si, 1.5% Cr, 0.5% Mn, and 1.3% C was determined to be .approximately 3° C. per minute. FIG. 3A shows this alloy after cooling according to this technique. The carbides were substantially spheroidal after cooling at a rate of 3° C. per minute as shown in FIG. 3A. Conversely, significant amounts of highly elongated or lamellar carbide structures were present after cooling at 20° C. per minute, as shown in FIG. 3B.

The critical cooling rate decreases as the rate of transformation from austenite to ferrite plus carbide decreases.

Method 3: Controlled Cooling with Associated Deformation with Comparison Example The cooling is controlled by either Method 1 or 2 above, and the steel is deformed both during and after substantial completion of the transformation.

The importance of controlled cooling rates during processing with associated deformation is demonstrated in FIGS. 4A–B and 5. In FIG. 4 (A and B), a UHCS alloy containing 1.5% Al, 1.5% Cr, 0.5% Mn, and 1.3% C was deformed both above and below the $A_1$ temperature, for comparison. The resultant structure consists of undesirable lamellar eutectoid carbides at both the edge (4A) and center (4B) of the plate. By decreasing the cooling rate of a matching plate given the same amount of deformation according to this invention, a substantially spheroidal carbide structure is formed, as shown in FIG. 5. An interrupted cooling process (Method 1) was applied in this case to allow completion of the transformation above 700° C.. The associated deformation refines the ferrite grain size to produce structures desirable for superplasticity.

Method 4: Controlled Cooling with Subsequent Deformation

The transformation is substantially completed using controlled cooling according to either Method 1 or 2 above, before deformation is conducted. In this way the deformation is concentrated on the spheroidized carbide plus iron (ferrite) matrix, which efficiently refines the ferrite grain size. An example of this method is shown in FIG. 6. A UHCS alloy with 1.6% Al, 1.5% Cr, 0.5% Mn, and 1.3% C was treated[according to Method 1 with interrupted cooling at 735° C. followed by 50% deformation by rolling at both 735° C. and 700° C. to produce a ferrite grain size of approximately 1 micron in diameter.

Method 5: Controlled Cooling with Subsequent Reheating an Deformation

The transformation is substantially completed using controlled cooling according to either Method 1 or 2 above. The deformation is then carried out at an optimum temperature for efficient refinement of the ferrite matrix. The optimum deformation temperature is below the $A_1$ temperature and may be above or below the temperature at which the transformation occurs during controlled cooling. In this method, the steel may be cooled to substantially below the transformation temperature, or even to room temperature, and then reheated to the optimum deformation temperature. The optimum deformation temperature must be determined for each case. In general, finer grain sizes are produced with low deformation temperatures.

COMPOSITIONS

The controlled cooling processes of this invention may be advantageously used to process ultrahigh carbon steels of the earlier compositions as described in U.S. Pat. Nos. 3,951,697 and 4,448,613, or such steels containing other alloying elements such as silicon or aluminum, as described in U.S. Pat. Nos. 4,533,390 and 4,769,214. The processes are particularly suitable for treating alloys with alloying additions that decrease the rate of the eutectoid transformation during cooling.

These new alloys form another aspect of this invention. The alloys of this invention have superplastic microstructures. They contain aluminum, for the purpose of raising the eutectoid transformation temperature and/or assisting in limiting the rate of carbide precipitation above the ($A_1$) eutectoid transformation temperature. These alloys also contain solute additions which act to both promote the formation of a fine grain size and improve the resistance of the carbides to coarsening at the forming temperature.

In particular, the new alloys contain carbon in an amount of from about 0.5 to about 2.1 weight percent, preferably from about 0.8 to about 1.8 weight percent and more preferably from about 1.2 to about 1.6 weight percent, and additional components as follows (listed in percentage range by weight):

(a) aluminum+chromium-containing: from about 0.5 to about 10, preferably from about 0.5 to about 3.5, more preferably from about 1.5 to about 2 weight percent aluminum; from about 1 to about 16, preferably from about 3 to about 10, more preferably from about 3 to about 9, still more preferably from about 4 to about 8, and most preferably from about 5 to about 7 weight percent chromium; and optionally from about 0.2 to about 2, preferably about 0.5 weight percent manganese;

(b) aluminum+chromium+molybdenum-containing: from about 0.5 to about 10, preferably from about 0.5 to about 3.5, most preferably from about 1.5 to about 2 weight percent aluminum; from about 0.25 to about 5, preferably from about 1 to about 3 weight percent molybdenum; from about 0.5 to about 5, preferably from about 0.5 to about 2 weight percent chromium; and optionally from about 0.2 to about 2, preferably about 0.5 weight percent manganese.

(c) aluminum+silicon+chromium-containing: from about 0.5 to about 3, preferably from about 0.5 to about 1.5, weight percent aluminum; from about 0.5 to about 5, preferably from about 1 to about 3, weight percent silicon; from about 1 to about 7 weight percent chromium; and optionally from about 0.2 to about 2, preferably about 0.5, weight percent manganese.

(d) aluminum+nickel+chromium-containing: from about 0.5 to about 10, preferably from about 0.5 to about 3.5, most preferably from about 1.5 to about 2, weight percent aluminum; from about 0.25 to about 5, preferably from about 0.5 to about 2, weight percent nickel; from about 1 to about 7, preferably from about 3 to about 5, weight percent chromium; and optionally from about 0.2 to about 2, preferably about 5, weight percent manganese.

(e) aluminum+chromium+manganese-containing: from about 0.5 to about 10, preferably from about 2 to about 3 or from about 6 to about 8, weight percent aluminum; from about 0 5 to about 10, preferably from about 2 to about 5, weight percent manganese; and from about 0.5 to about 7, preferably from about 1.5 to about 3, weight percent chromium.

The balance comprises iron.

Further included within this invention are compositions of steel products prepared by the processes described herein. Such compositions as listed above are exemplary as well as compositions as in (a) wherein chromium can be in a preferred weight percent range of from about 3% to about 10% among other compositions.

Exemplary compositions of these types are (amounts in weight percentages):

(a) Fe -1.5 Al -7 Cr -0.5 Mn -1.3 C
(b) Fe -1.5 Al -1 Cr -2 Mo -0.5 Mn -1.3 C
(c) Fe -1 Al -3 Cr -2 Si -0.5 Mn -1.3 C
(d) Fe -1.5 Al -4 Cr -1 Ni -0.5 Mn -1.3 C
(e) Fe -3 Al -1.5 Cr -2 Mn -1.3 C and
(f) Fe -7 Al -3 Cr -3 Mn -1.3 C Preferably the steels contain an aluminum:carbon ratio of greater than 0.5.

The descriptions of the foregoing embodiments of the invention have been presented for purposes of illustration. They are not intended to be exhaustive or to limit the invention to the precise form disclosed, and obviously many modifications and variations are possible in light of the above teachings. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

All references cited herein are hereby incorporated by reference.

We claim:

1. In a method for processing an ultrahigh carbon steel employing a divorced eutectoid transformation process in which the steel containing ferrite and carbide phases is heated to a soaking temperature approximately 50° C. above the $A_1$ transformation temperature and then soaked at a temperature above the $A_1$ temperature for a sufficient time that the major portion of the carbides dissolve into the austentite matrix, the step comprising:

thereafter cooling the steel in a controlled manner within limits of cooling rate dictated by the transformation rate and temperature whereby there is obtained a steel having substantially spheroidal carbides;

wherein the controlled cooling comprises cooling the steel to a second soaking temperature below the $A_1$ transformation temperature and above a lower temperature and holding at that temperature for a period of time sufficient for the substantial completion of the transformation, and further cooling the steel to room temperature.

2. In a method for processing an ultrahigh carbon steel employing a divorced eutectoid transformation process in which the steel containing ferrite and carbide phases is heated to a soaking temperature approximately 50° C. above the $A_1$ transformation temperature and then soaked at a temperature above the $A_1$ temperature for a sufficient time that the major portion of the carbides dissolve into the austentite matrix, the step comprising:

thereafter cooling the steel in a controlled manner within limits of cooling rate dictated by the transformation rate and temperature whereby there is obtained a steel having substantially spheroidal carbides;

wherein the controlled cooling comprises cooling the steel at a cooling rate not equivalent to air cooling, said rate being below an upper cooling rate limit until the eutectoid transformation is substantially completed followed by cooling to room temperature.

3. A method according to claim 1 in which the steel is deformed during and after the transformation.

4. A method according to claim 1 further comprising deforming the steel after the eutectoid transformation is substantially complete.

5. A method according to claim 1 further comprising reheating the steel to a deformation-suitable temperature and deforming the steel at said temperature.

6. A method according to claim 1 in which the minimum second soaking temperature is at most about 100° C. below the $A_1$ transformation temperature.

7. A method according to claim 2 in which the cooling rate is from about 0.01° C. to about 60° C. per minute.

8. A method according to claim 2 in which the cooling rate is from about 0.6° C. to about 20° C. per minute.

9. An ultrahigh carbon steel which possesses superplastic properties, consisting essentially of carbon in an amount of from about 0.5 to about 2.1 weight percent, and additional components selected from:

(a) from about 0.5 to about 10 weight percent aluminum; from about 3 to about 16 weight percent chromium; and optionally from about 0.2 to about 2 weight percent manganese; or (b) from about 0.5 to about 10 weight percent aluminum; from about 1 to about 5 weight percent molybdenum; from about 0.5 to about 5 weight percent chromium; and optionally from about 0.2 to about 2 weight percent manganese; or (c) from about 0.5 to about 3 weight percent aluminum; from about 0.5 to about 5 weight percent silicon; from about 1 to about 7 weight percent chromium; and optionally from about 0.2 to about 2 weight percent manganese; or (d) from about 0.5 to about 10 weight percent aluminum; from about 0.25 to about 5 weight percent nickel, from about 1 to about 7 weight percent chromium, and optionally from about 0.2 to about 2 weight percent manganese; or (e) from about 0.5 to about 10 weight percent aluminum; from about 0.5 to about 10 weight percent manganese; and from about 0.5 to about 7 weight percent chromium;

balance iron, totalling 100 weight percent and having substantially spheroidal carbides.

10. An ultrahigh carbon steel according to claim 9 in which the additional components are from about 0.5 to about 3.5 weight percent aluminum, from about 3 to about 9 weight percent chromium and optionally about 0.5 weight percent manganese.

11. An ultrahigh carbon steel according to claim 10 wherein the chromium is in a range of about 4 to about 8 weight percent.

12. An ultrahigh carbon steel according to claim 9 in which the additional components are from about 0.5 to about 3.5 weight percent aluminum; from about 1 to about 3 weight percent molybdenum; from about 0.5 to about 2 weight percent chromium; and optionally about 0.5 weight percent manganese.

13. An ultrahigh carbon steel alloy according to claim 9 in which the additional components are from about 0.5 to about 1.5 weight percent aluminum; from about 1 to about 3 weight percent silicon; from about 1 to about 7 weight percent chromium; and optionally about 0.5 weight percent manganese.

14. An ultrahigh carbon steel according to claim 9 in which the additional components are from about 1.5 to about 2 weight percent aluminum; from about 0.5 to about 2 weight percent nickel; from about 3 to about 5 weight percent chromium; and optionally about 0.5 weight percent manganese.

15. An ultrahigh carbon steel according to claim 9 in which the additional components are from about 2 to about 3 weight percent aluminum; from about 2 to about 8 weight percent manganese; and from about 1.5 to about 3 weight percent chromium.

16. An ultrahigh carbon steel according to claim 9 in which the additional components are from about 6 to about 8 weight percent aluminum; from about 2 to about 5 weight percent manganese; and from about 1.5 to about 3 weight percent chromium.

17. An ultrahigh carbon steel according to claim 9 wherein the carbon is in a weight percent range of about 0.8 to about 1.8.

18. An ultrahigh carbon steel according to claim 9 wherein the carbon is in a weight percent range of about 1.2 to about 1.6.

19. An ultrahigh carbon steel produced by a process according to claim 1, consisting essentially of carbon in an amount of from about 0.5 to about 2.1 weight percent, and additional components selected from:

(a) from about 0.5 to about 10 weight percent aluminum; from about 1 to about 16 weight percent chromium; and optionally from about 0.2 to about 2 weight percent manganese; or (b) from about 0.5 to about 10 weight percent aluminum; from about 1 to about 5 weight percent molybdenum; from about 0.5 to about 5 weight percent chromium; and optionally from about 0.2 to about 2 weight percent manganese; or (c) from about 0.5 to about 3 weight percent aluminum; from about 0.5 to about 5 weight percent silicon; from about 1 to about 7 weight percent chromium; and optionally from about 0.2 to about 2 weight percent manganese; or (d) from about 0.5 to about 10 weight percent aluminum; from about 0.25 to about 5 weight percent nickel, from about 1 to about 7 weight percent chromium, and optionally from about 0.2 to about 2 weight percent manganese; or (e) from about 0.5 to about 10 weight percent aluminum; from about 0.5 to about 10 weight percent manganese; and from about 0.5 to about 7 weight percent chromium;

balance iron, totalling 100 weight percent.

20. An ultrahigh carbon steel according to claim 19 further comprising aluminum in a weight percent range of from about 0.5 to about 10 and chromium in a weight percentage range of from about 2 to about 10.

21. An ultrahigh carbon steel according to claim 9 further comprising aluminum in a weight percent range of from about 0.5 to about 10 and chromium in a weight percent range of from about 2 to about 10.

22. An ultrahigh carbon steel according to claim 9 wherein the aluminum to carbon ratio is greater than 0.5.

23. An ultrahigh carbon steel according to claim 9 wherein the aluminum is at least 1.5 weight percent.

* * * * *